US005533283A

United States Patent [19]

Roth

[11] Patent Number: 5,533,283

[45] Date of Patent: Jul. 9, 1996

[54] COMPACTION ROLLER ASSEMBLY AND GRADER

[76] Inventor: Scott R. Roth, 848 Hidden Hills Dr., Bellevue, Nebr. 68005

[21] Appl. No.: 327,390

[22] Filed: Oct. 21, 1994

[51] Int. Cl.[6] ..... E01C 19/26

[52] U.S. Cl. ..... 37/142.5; 172/799.5; 404/124

[58] Field of Search ..... 37/142.5, 190, 37/269; 172/149, 150, 151, 197, 799.5, 199, 200; 404/124

[56] References Cited

U.S. PATENT DOCUMENTS

| | | | |
|---|---|---|---|
| 2,733,646 | 2/1956 | Sheffield | 172/195 |
| 2,965,053 | 12/1960 | Gruber | 172/149 |
| 3,950,110 | 4/1976 | Clifford | 404/124 |
| 3,966,346 | 6/1976 | Berrange | 404/124 |
| 4,147,448 | 4/1979 | Jeffery | 404/124 |
| 4,217,962 | 8/1980 | Schaefer | 172/799.5 X |
| 4,802,293 | 2/1989 | Smith | 37/269 X |
| 4,903,782 | 2/1990 | McCellan | 172/799.5 |
| 5,191,943 | 3/1993 | Minor et al. | 172/393 |

*Primary Examiner*—Terry Lee Melius
*Assistant Examiner*—Robert Pezzuto
*Attorney, Agent, or Firm*—Zarley, McKee, Thomte, Voorhees & Sease; Mark D. Frederiksen

[57] ABSTRACT

A compaction roller assembly includes a lobed non-circular impact roller operably mounted on a draw frame and a grader operably mounted behind the impact roller to level the corrugated ground surface produced by the impact roller. The grader includes a pair of diverging frame members with a pair of blades mounted thereon and depending therefrom with the lower edges of the blades lying within a generally horizontal plane. A plurality of teeth may be mounted to the frame members to scarify the soil, each tooth being removably connected to the frame members to permit ease of conversion between a grader blade and a scarifier. Each tooth is a generally flat plate, the plates oriented parallel to one another and parallel the line of travel of the grader. Each tooth plate forward edge includes a concave arc-shaped lower portion extending from the lower end of the tooth to a point proximal the lower edge of the blade. Removable support skids are provided to the frame member for supporting the grader in fine particulate soil.

17 Claims, 6 Drawing Sheets

COMPACTION ROLLER ASSEMBLY AND GRADER

TECHNICAL FIELD

The present invention relates generally to a compaction roller assembly, and more particularly to an improved compaction roller with a grading apparatus attached thereto.

BACKGROUND OF THE INVENTION

In large earth moving operations, it is often necessary to add dirt to build the elevation of the soil, for roads or other purposes. In order to provide an adequate foundation, compaction of the soil is necessary. Various methods and apparatus for compacting soil are well known in this field and one particular advance in compaction rollers is the type commonly referred to as an "impact roller".

Impact rollers have been known for some time, as evidenced by U.S. Pat. Nos. 3,950,110, 3,966,346 and 4,147,448, all which describe an impact roller and various modifications thereto. While the impact roller has proved to be an effective method of compacting soil, the impact roller leaves a corrugated surface finish which typically requires grading with separate equipment. More particularly, conventional graders with a horizontal blade are utilized to provide a flat surface finish which permits drainage of rain. On the other hand, a conventional scarifier is utilized to provide a broken up and loosened surface to permit the addition of further layers of dirt.

In either case, at least two additional pieces of equipment are necessary to finish the surface of the ground after use of the impact roller.

SUMMARY OF THE INVENTION

It is therefore a general object of the present invention to provide an improved compaction roller assembly with an integrated grader.

Another object of the present invention is to provide an improved impact roller assembly with an attached grading apparatus for providing a level finished surface.

A further object is to provide an impact roller assembly with a grading apparatus which is easily modified to provide either a flat surface finish or a scarified surface finish.

Yet another object of the present invention is to provide an impact roller assembly with an attached grader apparatus which is economical to manufacture, simple to use, and easily modified to provide different surface finishes.

These and other objects will be apparent to those skilled in the art.

The compaction roller assembly of the present invention includes a lobed non-circular impact roller operably mounted on a draw frame and a grader operably mounted behind the impact roller to level the corrugated ground surface produced by the impact roller. The grader includes a pair of diverging frame members with a pair of blades mounted thereon and depending therefrom with the lower edges of the blades lying within a generally horizontal plane. A plurality of teeth may be mounted to the frame members to scarify the soil, each tooth being removably connected to the frame members to permit ease of conversion between a grader blade and a scarifier. Each tooth is a generally flat plate, the plates oriented parallel to one another and parallel the line of travel of the grader. Each tooth plate forward edge includes a concave arc-shaped lower portion extending from the lower end of the tooth to a point proximal the lower edge of the blade. Removable support skids are provided to the frame member for supporting the grader in fine particulate soil.

DESCRIPTION OF THE PREFERRED EMBODIMENT

Figure 1:
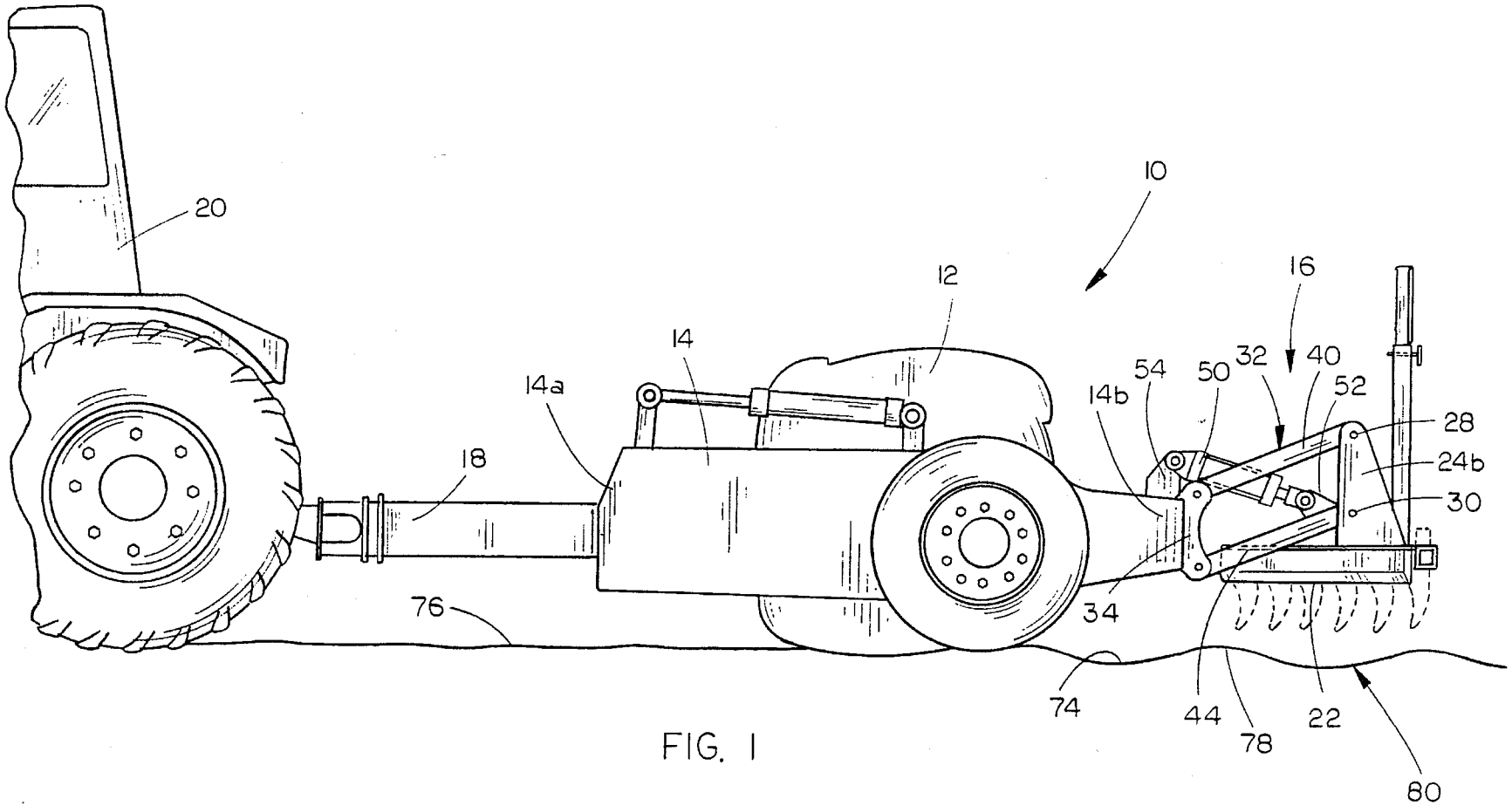
FIG. 1 is a side elevational view of the compaction roller with grader of the present invention.

Referring now to the drawings, in which similar or corresponding parts are identified with the same reference numeral, and more particularly to FIG. 1, the compaction roller assembly of the present invention is designated generally at 10 and includes a non-circular lobed impact roller 12 mounted on a draw frame 14, with an operable grader designated generally at 16 mounted to the rearward end **14*b* of draw frame 14. Draw frame 14 may either be self-propelled, or include a draw bar 18 projecting from the forward end 14*a* thereof, for connection to a tractor 20** or other prime mover.

Figure 2:
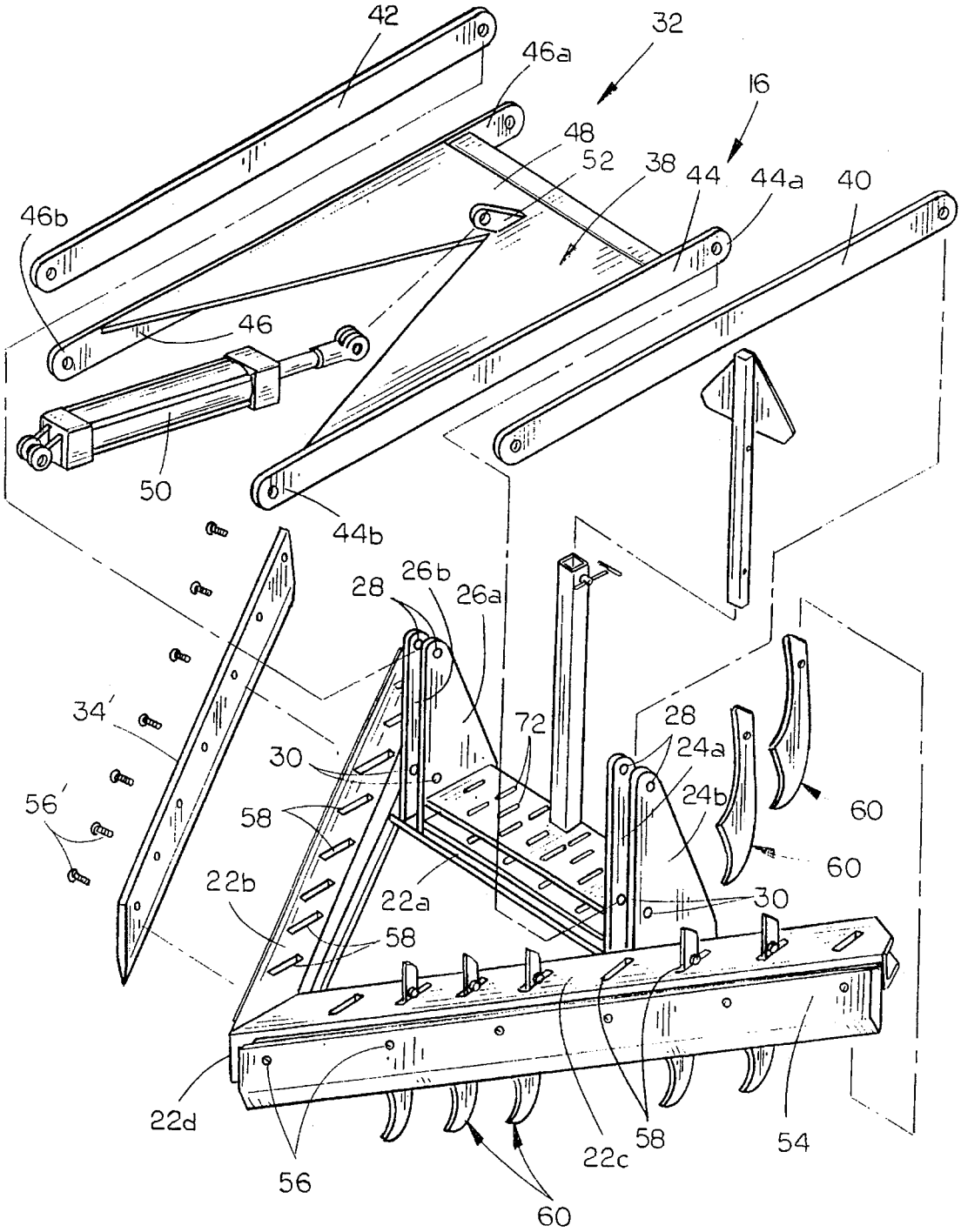
FIG. 2 is an exploded perspective view of the grader portion of the invention.
Figure 3:
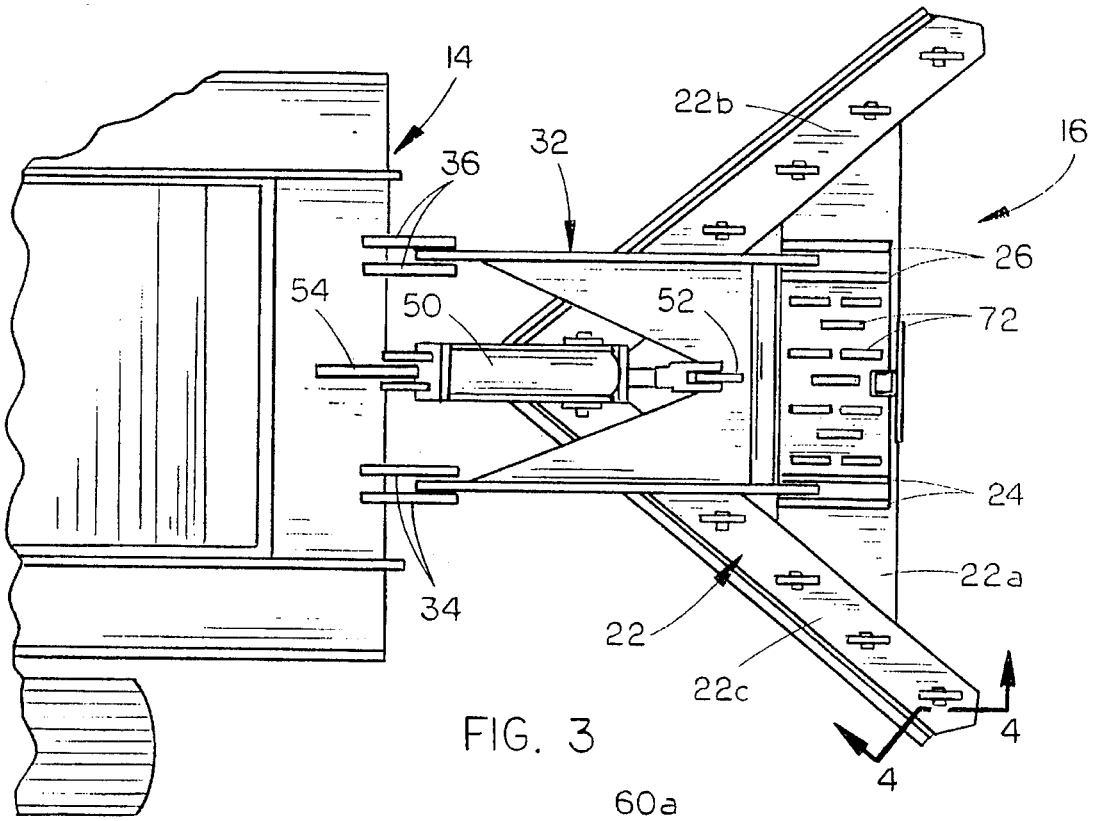
FIG. 3 is a top plan view of the grader attached to the compaction roller.

Referring now to FIGS. 2 and 3, grader 16 includes a generally triangular frame 22 having a base leg **22*a* oriented perpendicular to the direction of movement of the compaction roller assembly 10, and a pair of side legs 22*b* and 22*c* diverging rearwardly from a forward apex 22*d*. A first pair of uprights 24*a* and 24*b* are mounted at one end of frame base leg 22*a* and project upwardly therefrom. A second pair of uprights 26*a* and 26*b* extend upwardly from the opposing end of frame base leg 22*a*, as shown in FIG. 2. Each pair of uprights 24 and 26 includes a set of upper coaxial apertures 28 and lower coaxial apertures 30 to receive the rearward ends of linkage arms of a parallelogram linkage 32, shown in FIG. 1. As shown in FIG. 3, first and second pairs of upright flanges 34 and 36 respectively are aligned longitudinally with the first and second pair of uprights 24 and 26 respectively, to receive the forward end of parallelogram linkage 32**.

Parallelogram linkage 32, as shown in FIG. 1, serves to maintain grader frame 22 in a horizontal orientation as frame 22 is raised and lowered. This is critical for grader 16, in order to maintain a level ground surface after grading, as described in more detail hereinbelow. Parallelogram linkage 32 is shown in more detail in FIG. 2, and includes a lower linkage frame 38 and a pair of upper link arms 40 and 42. Lower linkage frame 38 includes a pair of lower link arms 44 and 46 connected together and maintained in spaced apart parallel relation by a plate 48. The rearward ends 44*a* and 46*a* of lower link arms 44 and 46 are pivotally connected to the lower set of apertures 30 in uprights 24 and 26 respectively, while the forward ends 44*b* and 46*b* are connected to a lower set of apertures in upright flanges 34 and 36 respectively. Similarly, upper link arm 40 is pivotally connected at its rearward end to the upper apertures 28 in first pair of uprights 24, and pivotally connected at its forward end to an upper set of apertures in first pair of upright flanges 34. Upper linkage arm 42 is pivotally connected at its rearward end to second uprights 26, and at its forward end to second pair of upright flanges 36.

An extensible cylinder 50 has one end connected to an ear 52 mounted on plate 48 of lower linkage frame 38, and its opposite end connected to a flange 54 (shown in FIG. 3) on the rearward end of draw frame 14. Thus, the extension or retraction of cylinder 50 will selectively raise and lower grader frame 22.

Figure 4:
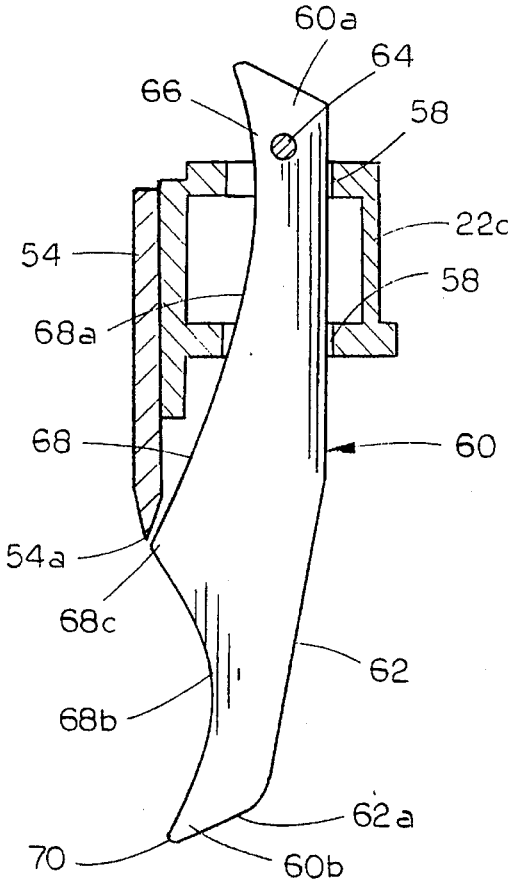
FIG. 4 is a sectional view taken at lines 4—4 in FIG. 3.

Referring once again to FIG. 2, grader frame side legs 22*b* and 22*c* are tubular members having upper and lower walls and forward and rearward walls. An elongated blade 54 is mounted to the forward wall of frame side leg 22*c* with screws 56, and has its lower edge 54*a* projecting downwardly beyond the lower end of the forward wall of frame side leg 22*c*, as shown in FIG. 4. Preferably, blade lower edge 54*a* is beveled to form a sharp grading edge. A second blade 54' is provided for frame side leg 22*b*, and attached to the forward wall thereof using screws 56', in the same fashion as blade 54. Thus, blades 54 and 54' form a V-shape when attached to grader frame 22, with blades 54 and 54' abutting together at the apex 22*d* of grader frame 22.

The upper and lower walls of grader frame side legs 22*b* and 22*c* are provided with a plurality of elongated slots 58. Slots 58 are parallel with one another, and parallel to a line bisecting the angle between grader frame side legs 22*b* and 22*c*, which follows the path of movement of the grader. Each slot 58 will receive a removable tooth 60, used for scarifying soil.

Referring now to FIG. 4, each tooth 60 is identical in shape and size and includes an upper end 62 which is inserted upwardly through vertically aligned slots 58 in frame side leg 22*b* or 22*c*. A removable pin 64 is inserted through an aperture 66 in tooth upper end 60*a*, to support the tooth on grader frame 22. Tooth 60 includes a generally vertically oriented forward edge 68 with an upper portion 68*a* and lower portion 68*b* having separate contours. Lower portion 68*b* of forward edge 68 is preferably concave in shape from the lower end 60*b* of tooth 60 to the juncture 68*c* of upper and lower portions 68*a* and 68*b*. Juncture 68*c* is specially positioned on tooth 60 so as to be placed immediately adjacent the lower edge 54*a* of blade 54. In this way, dirt which is forced upwardly along lower portion 68*b* of tooth 60 is moved forwardly in front of blade 54, rather than accumulating between blade 54 and tooth 60 or being pushed upwardly into frame side leg 22*c*.

The rearward edge 62 of tooth 60 is generally vertical, but includes a slanted portion 62*a* which slopes downwardly and forwardly at the lower end 60*b* of tooth 60 to form a point 70 at its juncture with the lower end of forward edge lower portion 68*b*. While the shape of forward edge upper portion 68*a* is not critical, the width of tooth 60, as measured between the forward and rearward edges 68 and 62, is less than the length of slots 58 at the upper end 60*a*, but greater than the length of slots 58 at juncture 68*c*. This width prevents tooth 60 from being forced upwardly through slots 58 and ejected from frame 22.

A plurality of slots 72 are provided in grader frame base leg 22*a* which are dimensioned to receive teeth 60, as shown in FIGS. 2 and 3, to permit the teeth to be retained on the piece of equipment for selective use as desired.

In operation, and referring once again to FIG. 1, compaction roller assembly 10 is drawn behind tractor 20 at a rate of approximately 7–9 miles per hour. The approximate weight of impact roller 12 is 30,000 pounds which applies a force of approximately 22,000 foot pounds per blow. Each individual blow of the impact roller thereby produces a valley 74 in the ground surface 76, separated by ridges 78 to form a corrugated ground surface 80 behind impact roller 12.

Figure 5:
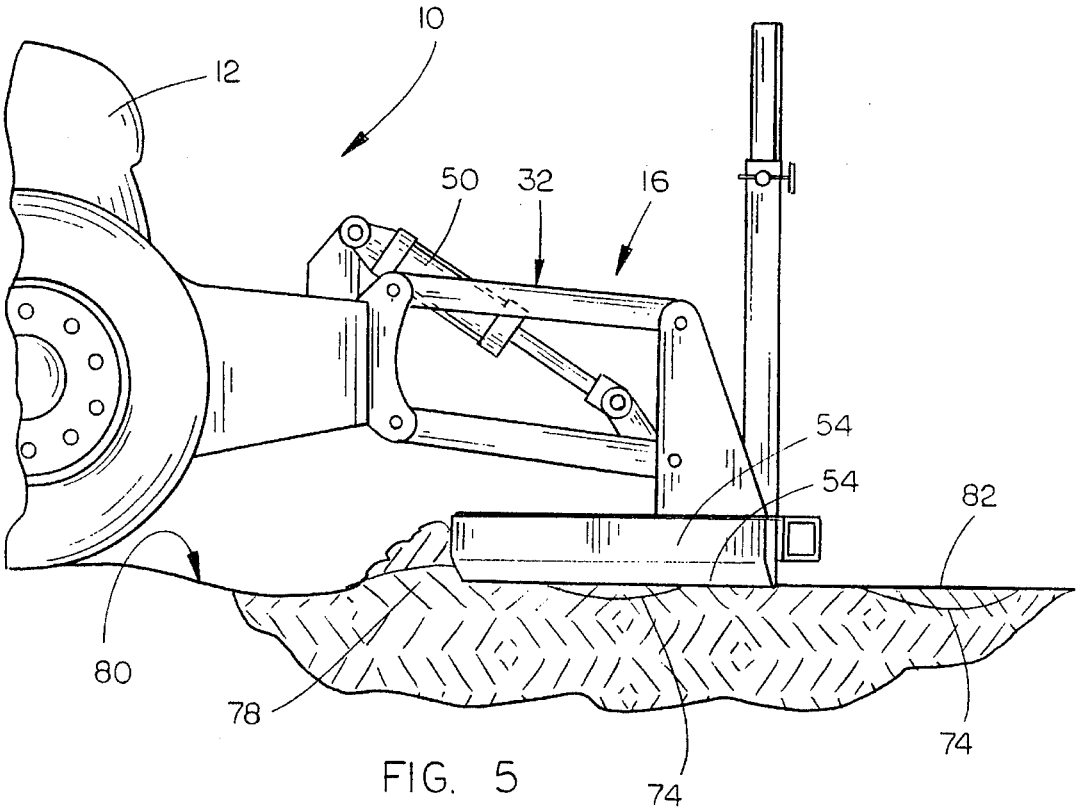
FIG. 5 is a side elevational view of the grader, with portions of the ground shown in sectional view.
Figure 6:
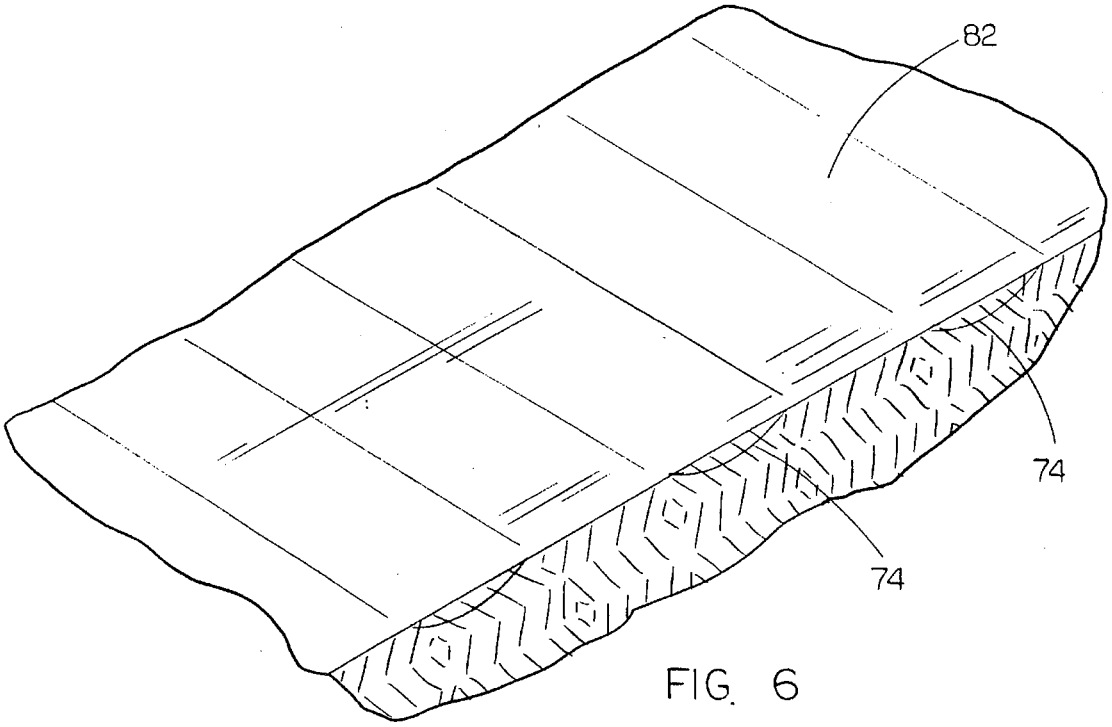
FIG. 6 is a perspective view of the ground surface after use of the grader blade shown in FIG. 5.
Figure 7:
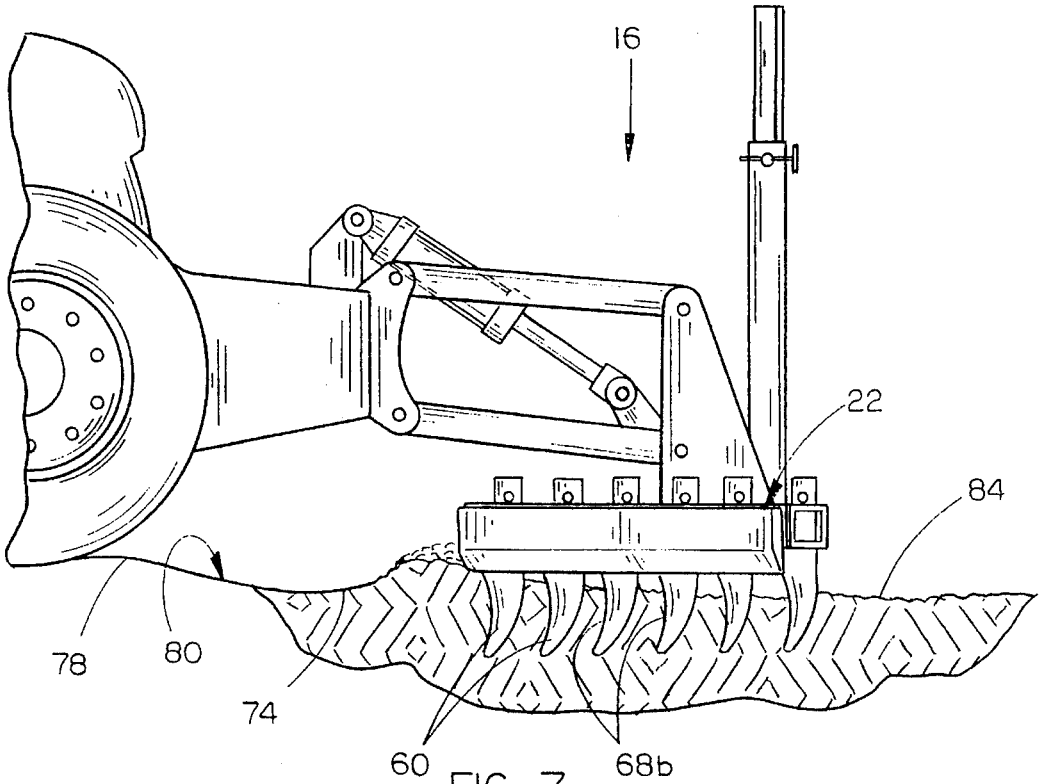
FIG. 7 is a side elevational view of the grader portion with the scarifier teeth in operation.

Grader 16 serves to automatically level the ground surface behind impact roller 12, as shown in FIGS. 5–8. Depending upon the particular surface finish desired, grader 10 may be utilized as a blade, as shown in FIG. 5 or as a scarifier as shown in FIG. 7. As shown in FIG. 5, grader 16 is lowered to the ground using cylinder 50, but then cylinder 50 is preferably deactivated to permit the weight of grader 16 to ride on blade 54. Parallelogram linkage 32 maintains blade 54 in a horizontal plane, while the lower edge 54*a* scraps the upper portion of ridges 78 and fills valleys 74 to provide a flat and level finished ground surface 82, shown in FIGS. 5 and 6. This smooth surface 82 is preferably when the potential for rain exists before another layer of dirt will be applied to the ground. The smooth, flat finish causes rain to run off the ground surface, so that the ground will dry faster and be ready for further treatment in a shorter amount of time.

Figure 8:
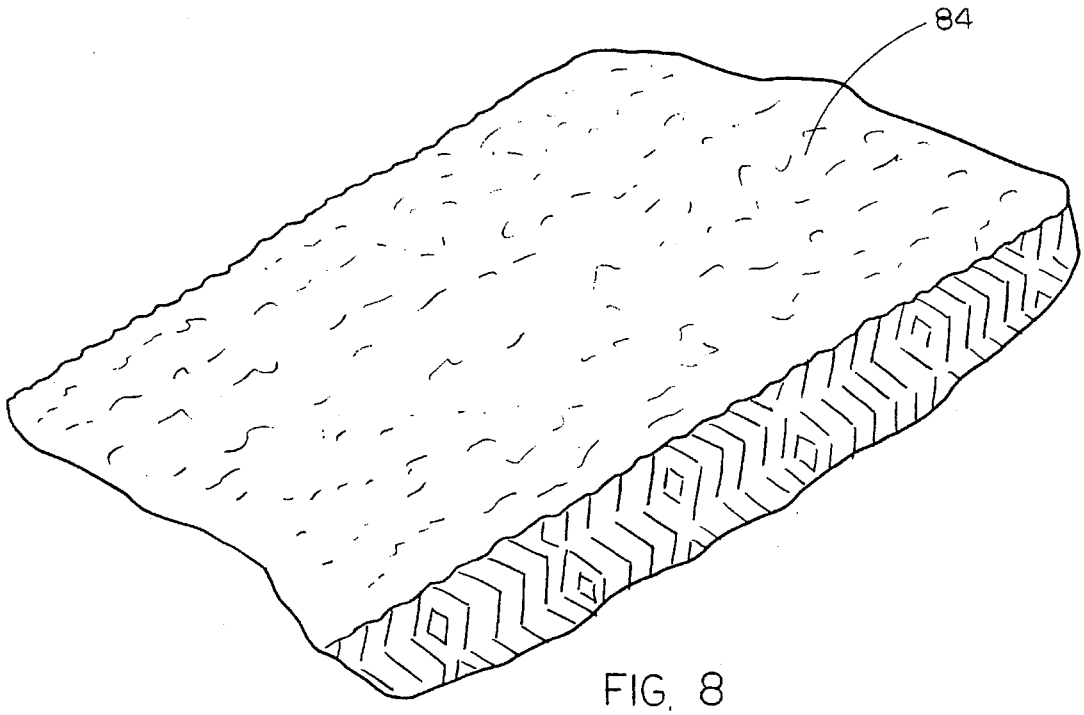
FIG. 8 is a perspective view of the ground surface after use of the grader shown in FIG. 7.

However, a smooth, flat finish is not desired if additional layers of dirt are to be added atop the ground surface. This is because the smooth, flat surface resists bonding with additional layers, thereby forming a laminate or plain which could cause additional layers of dirt to shift or slide, rather than bond and compact. For this reason, the alternative variation of grader 16 provides teeth 60 on frame 22, as shown in FIG. 7, to scarify the corrugated ground surface 80 as it levels the ridges and valleys 78 and 74. FIG. 7 shows that the concave shape of teeth forward edge lower portions 68*b* will cause the grader frame 22 to ride higher above the ground surface 80 than without the use of teeth 70. FIG. 7 and 8 show the resulting loose soil level ground surface 84 provided by grader 16 with teeth 60. The resulting scarified ground surface 84 is thus ready for additional layers of dirt to be added thereto.

Figure 9:
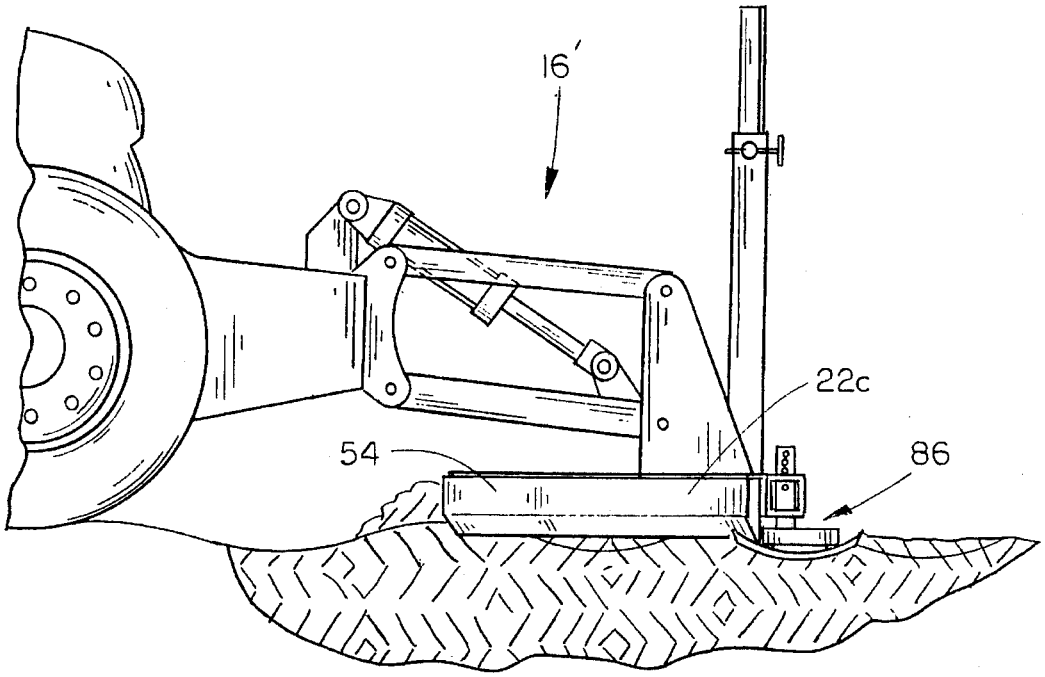
FIG. 9 is a side elevational view of a second embodiment of the grader blade.
Figure 10:
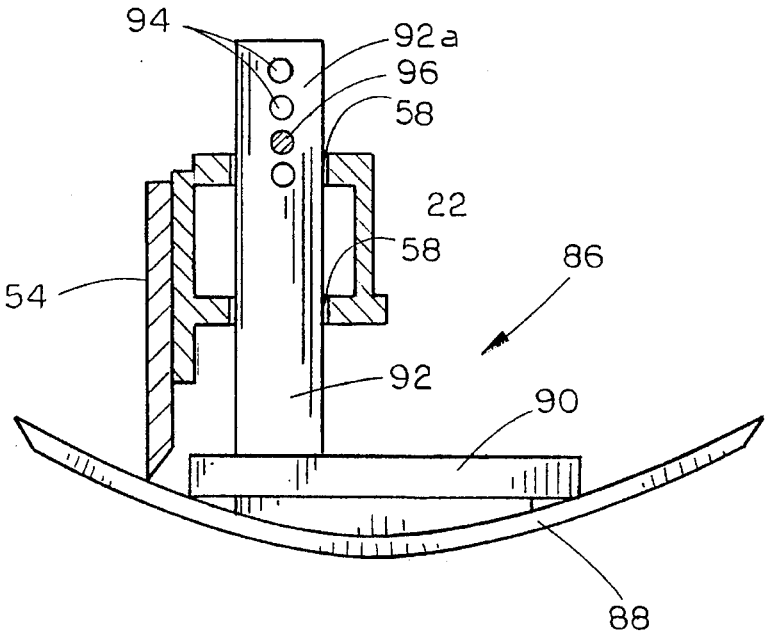
FIG. 10 is an enlarged sectional view showing one support shoe of the second embodiment of the invention.

Referring now to FIG. 9, a second embodiment of the grader is designated generally at 16' and is identical to the first embodiment, except for the addition of two support skids 86 positioned at the rearward ends of frame side legs 22*b* and 22*c* (although only leg 22*c* is shown in FIG. 9). As shown in FIG. 10, support skid 86 includes a shoe 88 formed of a plate bent arcuate from the forward to the rearward end and mounted to a base plate 90. An upright arm 92 projects upwardly from base plate 90 through slots 58 in frame side leg 22*c* and projects upwardly through the upper end of side leg 22*c*. A plurality of apertures 94 formed in the upper end 92*a* of arm 92 will receive a pin 96 which prevents skid 86 from dropping out of frame side leg 22*c*. Shoe 88 preferably extends forwardly under the blade 54, so as to project upwardly and forwardly of blade 54. The inventor has found that support skids 86 permit use of the compaction roller assembly 10 on loose material ground surfaces such as sand. Support skids 86 provide a broader support surface for blades 54 and grader 16' to prevent the weight of the grader from cutting too deeply into the ground surface of the loose soil.

Whereas the invention has been shown and described in connection with the preferred embodiments thereof, many modifications, substitutions, and additions may be made which are within the intended broad scope of the appended claims.

I claim:

1. A compaction roller assembly, comprising:

a lobed, non-circular impact roller operably mounted on a draw frame to produce a compacted, corrugated ground surface;

a grader operably mounted and cantilevered from a rearward end of the draw frame, for leveling the corrugated ground surface produced by the impact roller;

said grader operably mounted between an engaged position in engagement with the ground, and a storage position above the ground;

a parallelogram linkage pivotally interconnecting the grader with the draw frame; and means connected between the draw frame and grader for selectively pivoting the grader on the linkage between the engaged and storage position;

said grader including a pair of elongated blades mounted on a pair of frame members, said frame members diverging rearwardly from a forward apex;

each blade being mounted on one frame member and extending the length thereof such that said blades diverge from on another as they extend rearwardly from the frame apex;

each blade having a lower edge depending below the frame member to which the blade is attached; and said blade lower edges lying in a generally horizontal plane.

2. The compaction roller assembly of claim 1, wherein said blades extend rearwardly and outwardly to rearward ends, and wherein the distance between the rearward ends of the blades is greater than a lateral width of the impact roller.

3. The compaction roller assembly of claim 1, further comprising a plurality of teeth removably mounted on said pair of frame members, said teeth uniformly disposed from the apex to the rearward ends of the frame members, and having lower ends depending downwardly beyond the lower edges of the blades.

4. The compaction roller assembly of claim 3, wherein each said tooth is a generally flat plate having forward and rearward generally vertical opposing edges, said plates lying within generally parallel planes which are parallel to a line bisecting the diverging blades.

5. The compaction roller assembly of claim 4 wherein each tooth forward edge includes an upper portion and a lower portion and a juncture joining the upper and lower portions at an obtuse angle, the forward edge lower portion formed in a concave arc from the tooth lower end to the juncture.

6. The compaction roller assembly of claim 5, wherein each tooth is mounted to the frame such that each forward edge juncture is located proximal the lower edge of the blades.

7. The compaction roller assembly of claim 5, wherein each said tooth rearward edge has a lower portion sloped forwardly at a lower end to form a point at a juncture of the rearward edge lower end with the forward edge lower end.

8. The compaction roller assembly of claim 1, further comprising first and second support skids removably and adjustably mounted on each said frame member, for supporting said grader in fine particulate soil.

9. The compaction roller assembly of claim 8, wherein each said support skid includes a plate curved from a forward end to a rearward end to form an arc-shaped shoe, and an upright mounted on the shoe and removably and adjustably connected at an upper end to said grader frame member.

10. The compaction roller assembly of claim 9, wherein each said support skid is mounted with the shoe positioned under the blade, the forward end of each shoe projecting forwardly and upwardly beyond the lower edge of the blade, and the rearward end of each shoe projecting rearwardly and outwardly from the blade lower edge.

11. A grader for leveling ground, comprising:

a pair of elongated blades mounted on a pair of frame members, said frame members diverging rearwardly from a forward apex;

each blade being mounted on one frame member and extending the length thereof such that said blades diverge from one another as they extend rearwardly from the frame apex;

each blade having a lower edge depending below the frame member to which the blade is attached;

said blade lower edges lying in a generally horizontal plane; and a parallelogram linkage pivotally connecting said frame members with a tow vehicle, to maintain said blade lower edges in a generally horizontal plane during pivotal movement of the frame members.

12. The grader of claim 11, further comprising a plurality of teeth removably mounted on said pair of frame members, said teeth uniformly disposed from the apex to the rearward ends of the frame members, and having lower ends depending downwardly beyond the lower edges of the blades.

13. The grader of claim 12, wherein each said tooth is a generally flat plate having forward and rearward generally vertical opposing edges, said plates oriented in generally parallel planes which are parallel to a line bisecting the diverging blades.

14. The grader of claim 13, wherein each tooth forward edge includes an upper portion and a lower portion and a juncture joining the upper and lower portions at an obtuse angle, the forward edge lower portion formed in a concave arc from the tooth lower end to the juncture.

15. The grader of claim 14, wherein each tooth is mounted to one of said frame members such that each forward edge juncture is located proximal the lower edge of the blades.

16. The grader of claim 11, further comprising first and second support skids removably and adjustably mounted on each said frame member, for supporting said grader in fine particulate soil.

17. The grader of claim 16, wherein each said support skid includes a plate curved from a forward end to a rearward end to form an arc-shaped shoe, and an upright mounted on the shoe and removably and adjustably connected at an upper end to said grader frame member.

* * * * *